United States Patent [19]

Snyder

[11] 4,226,188

[45] Oct. 7, 1980

[54] SIDE BEARING ASSEMBLY

[75] Inventor: Richard C. Snyder, Michigan City, Ind.

[73] Assignee: Pullman Incorporated, Chicago, Ill.

[21] Appl. No.: 937,685

[22] Filed: Aug. 28, 1978

Related U.S. Application Data

[63] Continuation of Ser. No. 711,937, Aug. 5, 1976, abandoned.

[51] Int. Cl.[2] ..... B61F 5/14

[52] U.S. Cl. ..... 105/199 CB; 308/138

[58] Field of Search ..... 105/199 R, 199 C, 199 CB; 308/138, 224, 226

[56] References Cited

U.S. PATENT DOCUMENTS

| | | | |
|---|---|---|---|
| 1,748,412 | 2/1930 | Crawford | 308/138 |
| 3,400,669 | 9/1968 | Williams | 105/200 |
| 3,713,710 | 1/1973 | Wallace | 105/199 C |

*Primary Examiner*—Richard A. Bertsch

*Attorney, Agent, or Firm*—Richard J. Myers; Stephen D. Geimer; Paul A. Kerstein

[57] ABSTRACT

A shear resistant roll restraining means for arresting lateral rolling motion of a railway car including a side bearing upstanding from the truck bolster, a bearing plate structure vertically aligned and abuttably engageable with the side bearing depending from the upwardly and outwardly sloping bottom web of the car body bolster, and a bearing plate coupling having a longitudinal axis extending substantially coaxial with the direction of oscillatory impact loads of the side bearing on the bearing plate.

4 Claims, 3 Drawing Figures

SIDE BEARING ASSEMBLY

This is a continuation of Ser. No. 711,937, filed Aug. 5, 1976, now abandoned.

BACKGROUND OF THE INVENTION

1. Field of the Invention

This invention relates generally to railway cars and in particular to a shear resistant roll restraining means for a freight car.

2. Description of the Prior Art

During rail use of a railway car having a car body including transverse car body bolsters pivotally coupled and supported on transverse truck bolsters, discontinuieties in the track surface, truck hunting and the inertia of the car will cause the car body and therefore the car body bolsters to rock or roll relative to the truck bolsters. If this motion is not restrained or substantially arrested, the rocking motion will cause excessive wear and fatigue fracture of the center plate and bowl pivotally coupling the truck and car body bolsters. Additionally, when the car is operated on marginally serviceable track, excessive oscillatory rocking motion of the car body could cause derailment of the car. Thus, it is necessary to limit and very closely control the magnitude of the relative rocking motion between the truck and the car body bolsters.

The prior art discloses a variety of side bearing structures interposed between the truck and car bolsters to limit or control relative motion therebetween; i.e., U.S. Pat. Nos. 3,400,669 and 3,713,710 both show side bearings mounted on a truck bolster which abutably engage bearing plates depending from an associated car body bolster. As illustrated in U.S. Pat. No. 3,400,669, typically the depending bearing plate structures shown in the prior art are coupled to the upwardly and outwardly sloping bottom webs or plates of the car body bolster by rivets or similar fastening means which extend through the bearing plate support structure and the bolster web at an angle substantially perpendicular to the webs. While this structure clearly couples the bearing plates to the webs, experience has shown that vertical oscillatory impacts of the associated side bearings on the bearing plates develops shearing forces acting on the rivets. These shearing forces tend to bend and ultimately stretch the rivets after extended rail operations. Thus the integrity of the coupling between each bearing plate structure and the bolster web is destroyed and the critical clearance between the bearing plate and its associated side bearing which controls the magnitude of the relative rocking motion therebetween is obviated.

SUMMARY OF THE INVENTION

The present invention relates to a shear resistant car side roll restraining means for a railway car interposed between the truck bolster and an associated car body bolster to limit relative rocking motion therebetween.

The side roll restraining means includes a side bearing upstanding from the truck bolster and an upper side bearing plate structure depending from the upwardly and outwardly sloping bottom web of the car body bolster. The bearing plate structure includes a wedge secured to the bottom web which includes a substantially horizontal lower attachment surface to which the wear plate is secured by vertically extending removable bolts or related fastening means. It should be particularly noted that the removable bolts are vertically aligned and thus extend normal to the attachment surface so that the longitudinal axis of the bolts are coaxial with the direction of the oscillatory impact loading on the wear plate by the lower side bearing. By this means, shearing loads tending to stretch the bolts are essentially eliminated, thereby substantially enhancing the service life of the bearing plate structure.

The invention also discloses vertical shimming means sandwiched between each wear plate and wedge to facilitate vertical adjustment of the critical clearance between each side bearing and bearing plate structure.

DESCRIPTION OF THE PREFERRED EMBODIMENT

Figure 1:
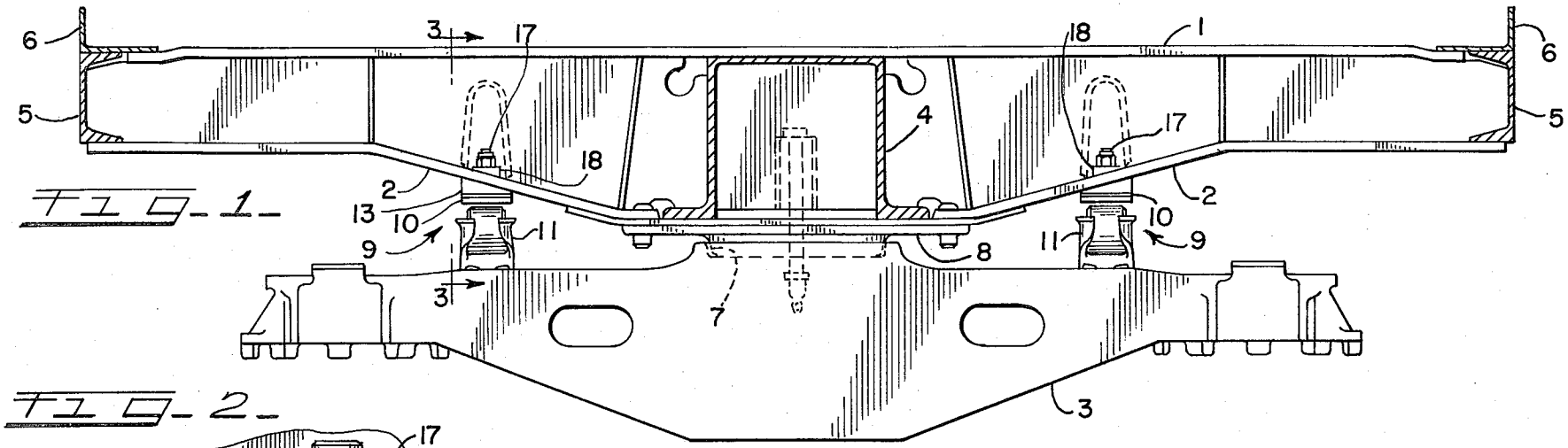
FIG. 1 is an end view of a railway car underframe having shear resistant roll restraining means interposed between the car and truck bolsters in accordance with and embodying the present invention.
Figure 2:
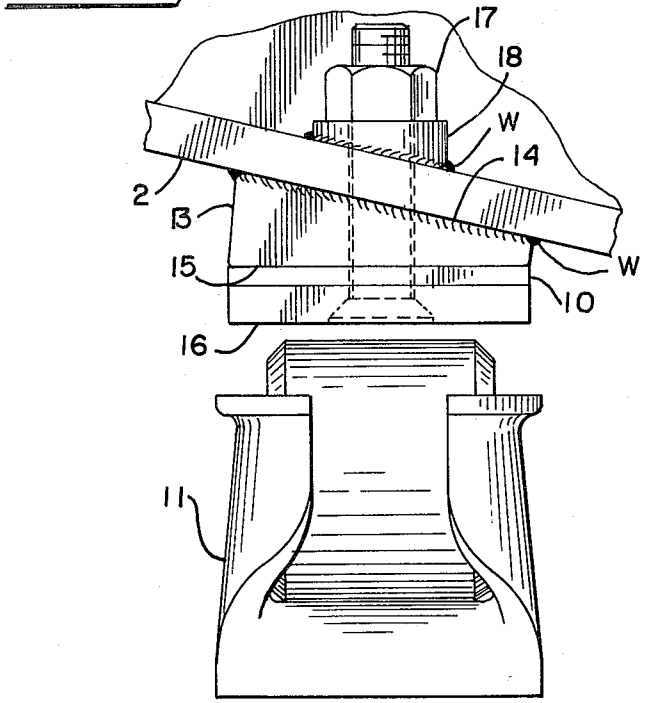
FIG. 2 is an enlarged fragmentary view of the roll restraining means shown in FIG. 1.
Figure 3:
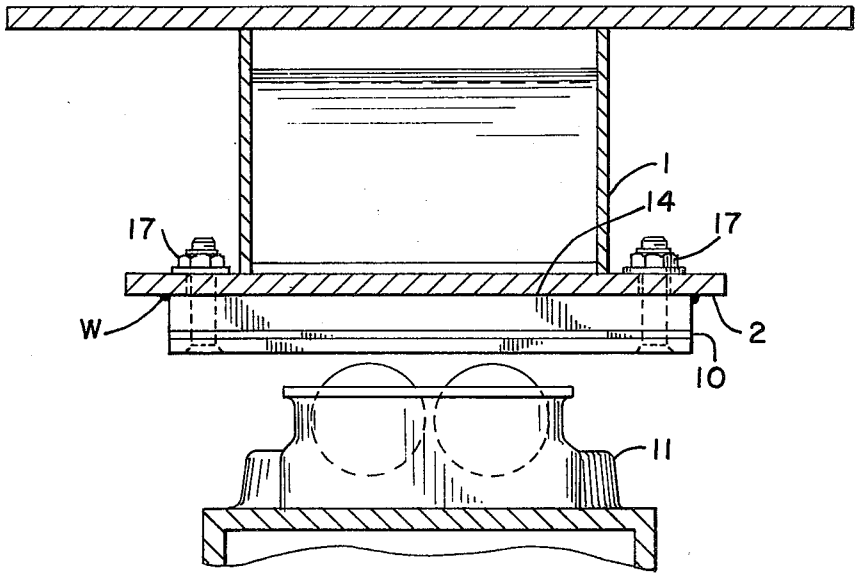
FIG. 3 is a fragmentary sectional view taken along line 3—3 of FIG. 1.

Turning now to consideration of the drawings and in particular FIG. 1, thereshown is a railway car bolster 1 having upwardly and outwardly sloping bottom web portions 2 supported on the truck bolster 3 of a conventional railway truck or boggie of a type which is well known in the art.

Although the present invention can be used in railway cars with or without center sills, the crosssection of the car underframe shown in the drawings illustrates a railway car underframe having a hat-shaped center sill 4 extending substantially the length of the car between spaced car trucks (not shown). The car bolsters 1 are coupled to the center sill 4 above each truck and extend outwardly therefrom to support side sills 5 extending substantially the length of the car which support the side walls 6 as well as a plurality of longitudinally spaced cross-members extending transversely therebetween. The ends of the truck bolster 3 are supported on truck side frames (not shown) which are in turn carried on the wheels of the truck. The truck bolster includes a center bowl portion 7 which cooperates with and carries a center plate bearing 8 secured to the underside of the car bolster 1 to pivotally support and couple the car bolster 1 to the truck bolster 3.

As discussed above in regard to the prior art, during rail operations discontinuities in the rail surface, truck hunting, the inertia of the car, etc. will cause the bolster to rock or roll relative to the truck bolster. If this motion is not restrained, excessive wear and ultimately failure of the center bearing 8 and bowl 7 will result, and, when the car is moved over particularly poor track, accelerating oscillatory rocking motion could cause derailment of the car. Thus it is necessary to limit and very closely control the magnitude of the relative rocking motion between the car and truck bolsters while at the same time providing a structure which can withstand the extreme fatigue loading characteristic of the railway operating environment.

The preferred embodiment of the present invention discloses a shear resistant roll restraining means 9 interposed between the car and truck bolsters which incorporates an adjustment or vertical shimming means 10 to insure that the critical magnitude of the rocking motion between the car and truck bolsters can be continuously monitored and controlled during field use of the railway car.

The roll restraining means 9 includes a lower side bearing 11 of a variety well known in the art supportably upstanding from the truck bolster 3 and an upper side bearing plate structure 12 depending from the upwardly and outwardly sloping bottom web portions 2 of the car body bolster 1 abutably aligned and spaced above the lower bearing 11 so that during rail operations the upper plate structure 12 and lower side bearing 11 will abutably engage one another and thereby arrest and limit lateral car roll.

As illustrated in the drawings, the upper side bearing plate structure 12 includes a wedge 13 having an upper surface 14 generally conforming to the slope of the bottom web 2 and a horizontal bottom surface portion 15. The wedge 13 is welded as indicated at w about its upper periphery or otherwise separately secured to the bottom web 2. To protect the wedge 13 from wear and to facilitate vertical adjustment of the clearance between the upper bearing plate structure and the lower bearing as will be more specifically discussed hereafter, a replaceable wear plate 16 is secured therebeneath by the nut and bolt combinations 17 which are vertically aligned to extend through the wear plate 16, wedge 13, bottom web portion 2 and the bevel washer 18 which is welded to the upper surface of the web portion 2. It should be particularly noted that since the bolts 17 are vertically aligned and therefore normal to the lower surface 15 of the wedge 13, the impact forces on the upper bearing plate structure 12 during rail use are coaxial with the axis of the bolts 17 such that there are no shearing forces imposed on them. Thus, the invention eliminates shearing forces on the bolts 17 by vertically aligning them with the vertically directed impact forces on the plate 16, thereby preventing bending and stretching of the bolts 17 which would result in loosening of the wear plates 16 and destruction of the critical clearance between the upper and lower bearings which controls the magnitude of lateral car rock or roll.

In the preferred embodiment of the invention the adjustment means 10 comprises a plurality of vertical shims 19 sandwiched between the wedge 13 and plate 16. This feature allows vertical adjustment of the clearance between the bottom of the plates 16 and the top of the lower bearings 11. Since in a typical freight car it may be necessary to maintain this clearance within a fraction of an inch, and because the vertical clearance essentially controls the magnitude of lateral roll of the car body, it is essential that the clearance be very closely monitored and controlled. Additionally, since after extended rail operations the wear plate 16 will wear down and thereby essentially obviate the critical clearance, the shims 19 provide a convenient and inexpensive means of repairing the upper plate structure without having to replace it.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A shear resistant roll restraining means for arresting lateral rolling motion of a railway car having a truck including a transverse truck bolster beam, a transverse car bolster beam having divergent laterally and upwardly sloping bottom web sections, and a center bearing means pivotally coupling and supporting the car bolster on the truck bolster, the improvement comprising:

a side bearing means upstanding from the truck bolster and being laterally spaced from said center bearing means, a wear plate assembly on said car bolster vertically aligned with and abuttably engageable with said side bearing means, said wear plate assembly including an alignment wedge depending from said web section and having an upper surface portion generally conforming thereto and a substantially horizontal bottom abutment surface, said wear plate assembly also including a horizontally extending wear plate supported below said bottom abutment surface, means defining vertically extending and aligned openings in said wear plate, said wedge and said web section, fastening means removably positioned within said vertically aligned openings and securing said wear plate to said wedge in vertical load transfer relation, and weld attachment means extending substantially about the periphery of said upper surface portion of said wedge and integrally uniting said wedge and said web section independently of said fastening means, thereby to eliminate bending of said fastening means due to shearing action between said wedge and said upwardly inclined web section when said horizontal bottom abutment surface of said wedge engages said side bearing means.

2. The invention according to claim 1, and vertical shimming means sandwiched between said wear plate and wedge.

3. The invention according to claim 2, and said shimming means comprising at least one flat plate having said fastening means extending therethrough.

4. The invention according to claim 1, and a bevel washer carried on the upper surface of said web section, and a weldment integrally securing said washer to said web.

* * * * *